US006806897B2

(12) United States Patent
Kataoka et al.

(10) Patent No.: US 6,806,897 B2
(45) Date of Patent: Oct. 19, 2004

(54) IMAGE RECORDING APPARATUS USING THE GRATING LIGHT VALVE

(75) Inventors: Yoshikazu Kataoka, Kyoto (JP); Eiichi Tamaki, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 32 days.

(21) Appl. No.: 10/279,819

(22) Filed: Oct. 25, 2002

(65) Prior Publication Data

US 2003/0085987 A1 May 8, 2003

(30) Foreign Application Priority Data

Nov. 8, 2001 (JP) ..... P2001-342767

(51) Int. Cl.[7] ..... B41J 2/47; B41J 27/00
(52) U.S. Cl. ..... 347/256; 347/255
(58) Field of Search ..... 347/239, 241, 347/255, 256, 238; 372/35

(56) References Cited

U.S. PATENT DOCUMENTS 6,280,038 B1 8/2001 Fuse et al. ..... 353/57
6,400,444 B2 6/2002 Suzuki
6,650,354 B2 * 11/2003 Morizono et al. ..... 347/255
2003/0086453 A1 * 5/2003 Nolan ..... 372/35

FOREIGN PATENT DOCUMENTS

| | | |
|---|---|---|
| JP | 62231973 | 10/1987 |
| JP | 6-29181 | 2/1994 |
| JP | 10-27751 | 1/1998 |
| JP | 2000-131628 | 5/2000 |

* cited by examiner

*Primary Examiner*—Hai Pham
(74) *Attorney, Agent, or Firm*—McDermott Will & Emery LLP

(57) ABSTRACT

An optical head 1 of an image recording apparatus 10 is provided with a light-source water-cooling jacket 41 for cooling a light source 11 and a device water-cooling jacket 42 for cooling the Grating Light Valve 12 and a light-shield water-cooling jacket 43. The optical head 10 is also provided with a mirror 31 for reflecting a light form the light source 11 in a non-recording status and mirrors 32, 33 for reflecting non-signal light beams from the light valve 12, and the lights from these mirrors are directed to the light-shield water-cooling jacket 43. Further, a refrigerant from a chiller unit goes through the light-source water-cooling jacket 41, the device water-cooling jacket 42 and the light-shield water-cooling jacket 43 in this order. With this constitution, it is possible to efficiently cool all the heat sources and in the optical head.

9 Claims, 4 Drawing Sheets

IMAGE RECORDING APPARATUS USING THE GRATING LIGHT VALVE

BACKGROUND OF THE INVENTION

1. Field of the Invention

The present invention relates to an apparatus for recording an image on a recording medium using a multi-channel light modulator.

2. Description of the Background Art

An image recording apparatus using the Grating Light Valve (trademarked by Silicon Light Machines, Sunnyvale, Calif.) to modulate light from a semiconductor laser has been proposed. The semiconductor laser is usually cooled so as to stabilize the wavelength and the output power and ensure its lifetime. On the other hand, Japanese Patent Application Laid Open Gazette No. 2000-131628 discloses an image recording apparatus which is additionally provided with a cooling system for cooling the light modulator.

The Grating Light Valve converts the incident light into non-diffracted and diffracted beams, which are used as signal beams and non-signal beams. The non-signal beams are blocked not to reach the recording medium. If the laser power is high, the blocked light energy has to be removed by a cooling system.

Generally the laser source is kept turned on as long as the recording apparatus is in operation so as to stabilize its temperature. The laser energy, which is often blocked by a shutter, needs removing, too.

SUMMARY OF THE INVENTION

The present invention is intended for an image recording apparatus with a high-power laser for recording an image on a recording medium, and a main object of the present invention is to adequately suppress temperature rise in the image recording apparatus.

According to an aspect of the present invention, the image recording apparatus comprises a light source comprising a semiconductor laser; the Grating Light Valve to modulate the light from the light source; a holding member for holding the recording medium which is exposed to signal beams from the light modulator; a light shielding member for blocking undesired light; and a light-shield cooling member for removing heat generated by blocking the undesired light.

In the image recording apparatus of the present invention, it is possible to adequately prevent ill-effect of heat on an optical system by removing the heat generated by blocking the undesired light.

According to a preferred embodiment of the present invention, there are a light-shield cooling member for removing the light energy and a light-shielding member for directing the light from the light source to the light-shield cooling member. According to another preferred embodiment of the present invention, the light shielding member comprises a mirror which reflects a non-signal light from the light modulator, and the light-shield cooling member is irradiated with the light which is reflected by the mirror, to remove the heat generated by irradiation.

In the image recording apparatus of these preferred embodiments, the heat generated by light shielding is carried away from the optical system.

The present invention is also intended for a technique for efficiently removing heat generated in the apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
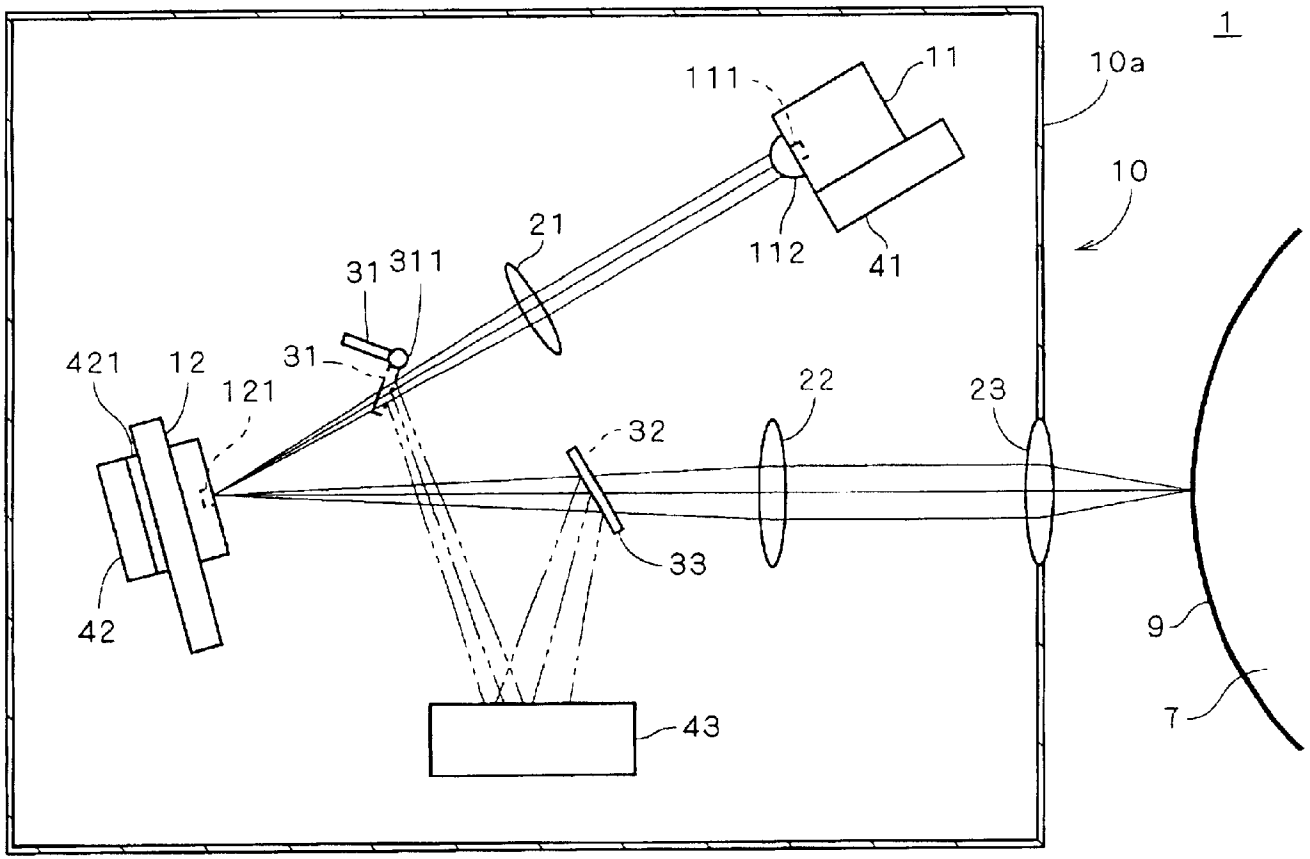
FIG. 1 is a view showing a constitution of an image recording apparatus in accordance with a first preferred embodiment.

FIG. 1 is a view showing a constitution of an image recording apparatus 1 in accordance with the first preferred embodiment of the present invention. The image recording apparatus 1 has an optical head 10 which emits light for recording an image and a holding drum 7 for holding a recording medium 9, such as a printing plate, a photosensitive film and the like. A photosensitive drum for plateless printing may be used as the holding drum 7 and in this case, it is understood that the recording medium 9 corresponds to a surface of the photosensitive drum.

The optical head 10 with a cover 10*a* keeping dust off is moved by a moving mechanism (not shown) in a direction perpendicular to the paper. The holding drum 7 rotates about an axis in parallel to the moving direction of the optical head 10. By rotating the holding drum 7 while moving the optical head 10, an image is recorded on the recording medium 9.

The optical head 10 has a semiconductor laser (hereinafter, referred to as "light source") 11 having laser emitters 111, the Grating Light Valve 12 to which light from the light source 11 is delivered through a lens 21. Signal beams from the light modulator 12 reach the holding drum 7 through lenses 22 and 23. The optical head 10 further has a mirror 31 that can be inserted into the optical path, mirrors 32 and 33 to block non-signal beams from the light modulator 12, a light-source water-cooling jacket 41, a device water-cooling jacket 42 and a light-shield water-cooling jacket 43. The device water-cooling jacket 42 cools light modulator elements 121 through the heat spreader 421 attached to the light modulator 12.

Lights from the laser emitters 111 are collimated in a direction parallel to the paper by a lens 112. The lights from a plurality of emitters are overlapped on the light modulator 12 while being superimposed by the lens 21.

The light modulator elements 121 are manufactured by using a semiconductor manufacturing technique, and each of the light modulator elements 121 is a diffraction grating which can change the depth of grooves. More specifically, a plurality of ribbon-like members are formed in parallel to one another along a reference plane, and the depth of grooves of the diffraction grating is changed by up-and-down movement of the ribbon-like members with respect to the reference plane. By changing the depth of grooves, the light modulator element 121 creates a zeroth-order diffracted light (i.e., non-diffracted light) and +/− first-order or higher order diffracted lights.

The mirror 31 fixed to the drive shaft 311 is inserted to the optical path so as to direct the light from the light source 11 to the jacket 43 in a non-recording status, while placed away from the optical path in a recording status.

Figure 2:
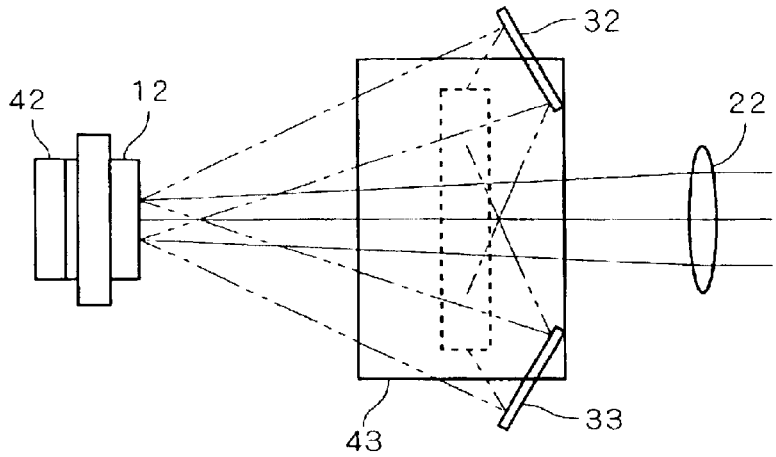
FIG. 2 is a schematic plan view of an optical head in accordance with the first preferred embodiment.

The mirrors 32 and 33 receive the non-signal lights from the light modulator 12, as discussed above, and direct the non-signal lights to the light-shield water-cooling jacket 43. FIG. 2 is a plan view of the optical head 10, schematically showing how the mirrors 32 and 33 are disposed. The light-source water-cooling jacket 41 cools the light source 11 so as to stabilize the wavelength and the output power and ensure its lifetime. The device water-cooling jacket 42 efficiently cools the light modulator 12 through the heat spreader 421 so as to ensure its stability and lifetime. The light-shield water-cooling jacket 43 removes heat generated by irradiation with the light from the mirrors 31 to 33.

Mirrors 31, 32 and 33 are oriented so that all of the reflected beams hit about the same position of the jacket 43. This allows reduction in size of the light-shield water-cooling jacket 43. The light receiving surface on the light-shield water-cooling jacket 43 is made of such a material as to efficiently absorb the light from the light source 11.

As discussed above, in the optical head 10 of the image recording apparatus 1, since all of the constituent elements which cause heat generation, i.e., the light source 11, the light modulator 12 and the light receiving surface of the light-shield water-cooling jacket 43 are simultaneously cooled, it is possible to adequately suppress a temperature rise in the optical head 10. This helps preventing misalignment of the optics.

Figure 3:
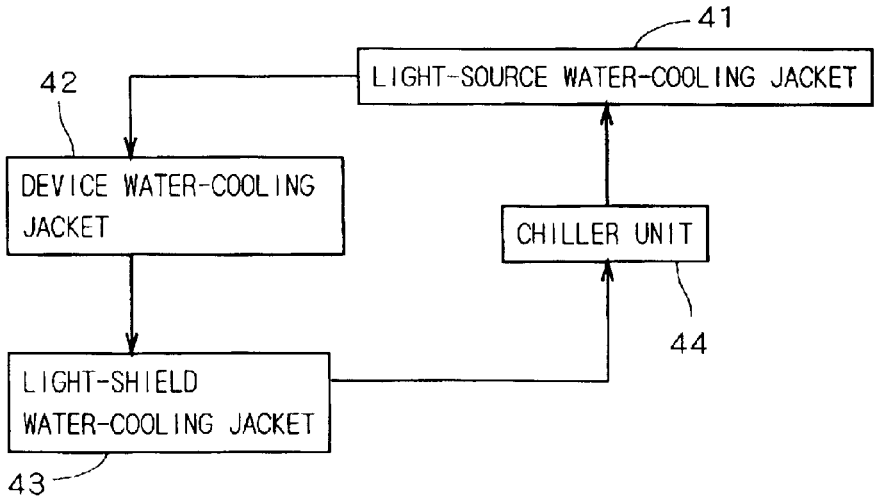
FIG. 3 is a block diagram showing how a refrigerant is circulated.

FIG. 3 is a block diagram showing a state where a refrigerant is carried through the light-source water-cooling jacket 41, the device water-cooling jacket 42 and the light-shield water-cooling jacket 43. The image recording apparatus 1 comprises a chiller unit 44 for cooling the refrigerant and controlling temperature, and the refrigerant sent out from the chiller unit 44 goes through the light-source water-cooling jacket 41, the device water-cooling jacket 42 and the light-shield water-cooling jacket 43 in this order and is returned to the chiller unit 44. The chiller unit 44 has a tank for pooling the refrigerant, a cooling member for cooling the refrigerant in the tank, a temperature control circuit for controlling the cooling of the refrigerant and a pump for sending out the refrigerant.

In comparison between the light source 11 and the light modulator 12, the light modulator 12 does not need as highly accurate temperature control as the light source 11. For example, the temperature of the semiconductor laser has to be controlled with accuracy of ±1° C., while the light modulator 12 only has to be cooled under a predetermined temperature to keep energy absorption from doing harm to the modulator.

Figure 4:
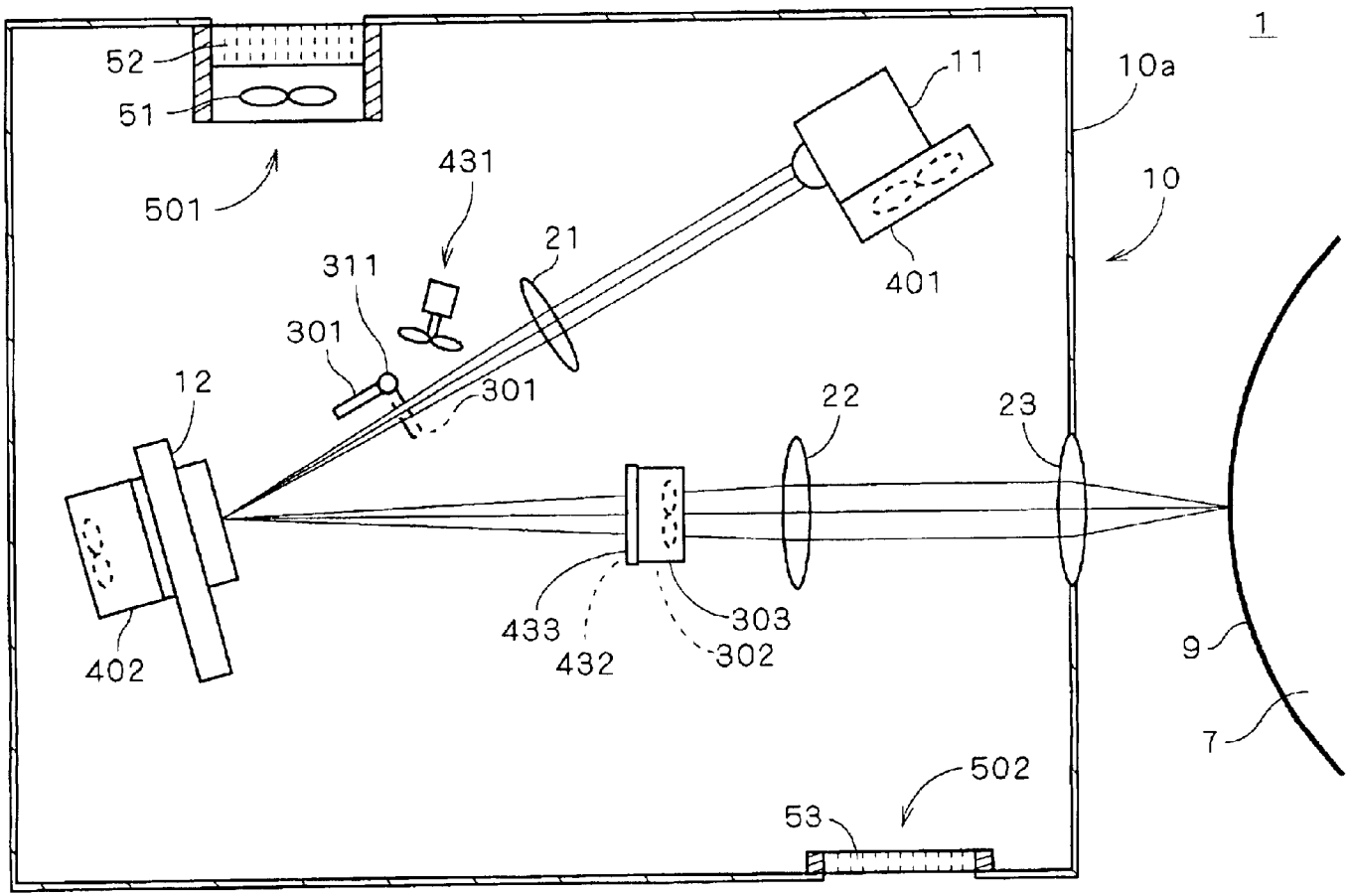
FIG. 4 is a view showing a constitution of an image recording apparatus in accordance with a second preferred embodiment.

FIG. 4 is a view showing a constitution of the image recording apparatus 1 in accordance with the second preferred embodiment of the present invention. In FIG. 4, the constituent elements identical to those in the first preferred embodiment are represented by the same reference signs, and like in the first preferred embodiment, the light from the light source 11 is directed to the light modulator 12 through the lens 21 and the signal lights from the light modulator 12 are directed to the recording medium 9 held by the holding drum 7 through the lenses 22 and 23. In the image recording apparatus 1 of the second preferred embodiment, the light source 11, the light modulator 12 and the constituent elements relevant to light shielding in the optical head 10 are air-cooled.

As the constituent elements relevant to light shielding provided are a light shielding plate 301 for blocking the light from the light source 11, two light shielding plates 302 and 303 for blocking the non-signal lights from the light modulator 12. The light shielding plate 301 is rotatable about the drive shaft 311 and its attitude is changed between a position on the optical path from the light source 11 to the light modulator 12 and a position off the optical path.

The light source 11 is cooled by a fan unit 401 and the light modulator 12 is cooled by a fan unit 402. On the other hand, the light shielding plate 301 is cooled by an airflow from a fan 431 when it is irradiated with the light from the light source 11. The light shielding plates 302 and 303 are air-cooled by fan units 432 and 433, respectively.

Figure 5:
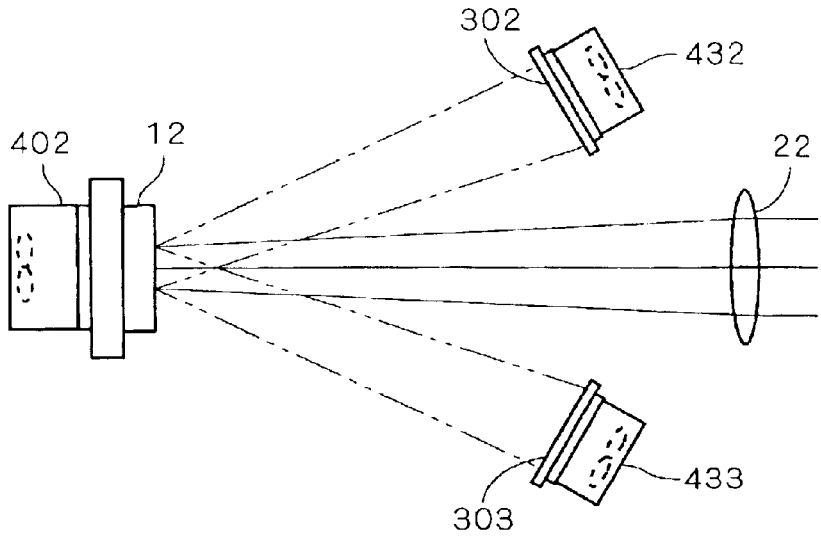
FIG. 5 is a schematic plan view of an optical head in accordance with the second preferred embodiment.

Though FIG. 4 is a view of the image recording apparatus 1 as viewed from side and therefore the light shielding plates 302 and 303 are shown as if they are on an optical axis, overlapping each other, in fact, the light shielding plates 302 and 303 are provided at predetermined portions in the direction perpendicular to the paper with the optical axis interposed therebetween. FIG. 5 is a plan view of the optical head 10, schematically showing a positional relation of these light shielding plates. As can be seen from FIG. 5, the light shielding plates 302 and 303 are disposed symmetrically with respect to the optical axis.

In the optical head 10, further, the cover 10*a* is provided with an air inlet 501 and an air outlet 502, and in the air inlet 501, a fan 51 and a filter 52 are disposed and in the air outlet 502, a simple filter 53 is disposed. The optical head 10 thereby takes in an outside air from the fan 51 and the filter 52 and ejects the air used for air-cooling through the filter 53.

Also in the image recording apparatus 1 of the second preferred embodiment, since the light source 11, the light modulator 12 and the light shielding plates 301 302, and 303 which cause heat generation are cooled, it is possible to adequately suppress temperature rise in the optical head 10.

Though the preferred embodiments of the present invention have been discussed above, the present invention is not limited to the above-discussed preferred embodiments, but allows various variations.

The light source 11 in the preferred embodiments is not limited to a semiconductor laser bar, but may be a semiconductor laser having a single emitter or a semiconductor laser array comprising a plurality of diodes. For stricter temperature control, Peltier modules can be added to the above embodiments.

The refrigerant is not limited to water, but other refrigerants may be used.

While the invention has been shown and described in detail, the foregoing description is in all aspects illustrative and not restrictive. It is therefore understood that numerous modifications and variations can be devised without departing from the scope of the invention.

What is claimed is:

1. An image recording apparatus for recording an image on a recording medium by exposure, comprising:

a light source comprising a semiconductor laser;

a Grating Light Valve for modulating light from said light source;

a holding member for holding said recording medium which is exposed to modulated light from said light valve;

a first mirror for blocking non-signal light beams from said light valve a second mirror for blocking light between said light source and said light valve in a non-recording status; and a light-shield cooling member for absorbing said non-signal light beams reflected by said first mirror and said light reflected by said second mirror.

2. An image recording apparatus for recording an image on a recording medium by exposure comprising:

a light source comprising a semiconductor laser;

a grating light valve for modulating light from said light source;

a holding member for holding said recording medium which is exposed to the modulated light from said light valve;

a light shielding member for blocking undesired light;

a temperature control member for controlling temperature of a refrigerant;

a light-shield cooling member for removing heat generated by blocking said undesired light with said refrigerant;

a light-source cooling member for cooling said light source with said refrigerant; and wherein said refrigerant from said temperature control member noes through said light-source cooling member and said light-shield cooling member in this order and is returned to said temperature control member.

3. The image recording apparatus according to claim 2, further comprising:

a device cooling member for cooling said light valve with said refrigerant, wherein said refrigerant goes through said light-source cooling member, said device cooling member and said light-shield cooling member in this order.

4. The image recording apparatus according to claim 3, wherein said light source, said light valve and said light shielding member are shrouded by a sealing cover.

5. The image recording apparatus according to claim 2, wherein said light shielding member blocks light between said light source and said light valve in a non-recording status.

6. The image recording apparatus according to claim 2, wherein said light shielding member blocks non-signal light beams from said light valve.

7. An image recording apparatus for recording an image on a recording medium by exposure comprising:

a light source comprising a semiconductor laser;

a grating light valve for modulating light from said light source;

a holding member for holding said recording medium which is exposed to the modulated light from said light valve;

a light shielding member for blocking undesired light;

a temperature control member for controlling temperature of a refrigerant;

a device cooling member for cooling said light valve with said refrigerant; and a light-shield cooling member for removing heat generated by blocking said undesired light with said refrigerant, wherein said refrigerant from said temperature control member goes through said device cooling member and said light-shield cooling member in this order and is returned to said temperature control member.

8. The image recording apparatus according to claim 7, wherein said light shielding member blocks light between said light source and said light valve in a non-recording status.

9. The image recording apparatus according to claim 7, wherein said light shielding member blocks non-signal light beams from said light valve.

* * * * *